United States Patent [19]

Hage et al.

[11] Patent Number: 4,524,822

[45] Date of Patent: Jun. 25, 1985

[54] SAFETY HEAT-TRANSMITTING DEVICE

[75] Inventors: Manfred Hage, Ulm-Wiblingen; Otto Junker, Gerlenhofen, both of Fed. Rep. of Germany

[73] Assignee: Wieland-Werke AG, Ulm, Fed. Rep. of Germany

[21] Appl. No.: 489,394

[22] Filed: May 3, 1983

Related U.S. Application Data

[62] Division of Ser. No. 221,164, Dec. 29, 1980, abandoned.

[51] Int. Cl.[3] ..... F28D 15/00

[52] U.S. Cl. ..... 165/141; 165/70; 165/104.21; 165/104.14; 165/154; 62/238.6

[58] Field of Search ..... 165/104.14, 104.21, 165/154, 141, 70; 62/238.6

[56] References Cited

U.S. PATENT DOCUMENTS

| | | | |
|---|---|---|---|
| 2,022,764 | 12/1935 | Gibson et al. | 62/333 X |
| 2,125,842 | 8/1938 | Eggleston | 62/238.6 |
| 3,473,348 | 10/1969 | Bottum | 165/154 |
| 3,621,906 | 11/1971 | Leffert | 165/104.14 |
| 3,651,551 | 3/1972 | Cannon | 165/141 |
| 3,788,388 | 1/1974 | Barbmann | 165/104.14 |
| 3,854,454 | 12/1974 | Lazaridis | 122/33 |
| 3,971,634 | 7/1976 | Ranben et al. | 165/104.14 |
| 4,131,158 | 12/1978 | Abhat et al. | 165/104.14 |
| 4,333,525 | 6/1982 | Ikin et al. | 165/104.21 |

FOREIGN PATENT DOCUMENTS

| | | | |
|---|---|---|---|
| 78101332.1 | 5/1979 | European Pat. Off. . | |
| 739991 | 10/1943 | Fed. Rep. of Germany | 165/104.21 |
| 2656030 | 6/1978 | Fed. Rep. of Germany . | |
| 1294211 | 4/1962 | France | 165/104.21 |
| 2408805 | 6/1979 | France . | |
| 71754 | 6/1977 | Japan | 165/104.21 |
| 107892 | 8/1980 | Japan | 165/104.21 |
| 160250 | 12/1980 | Japan | 165/104.21 |
| 214877 | 5/1924 | United Kingdom | 165/104.21 |
| 2004635 | 4/1979 | United Kingdom . | |
| 320698 | 12/1971 | U.S.S.R. | 165/70 |

*Primary Examiner*—Albert W. Davis, Jr.

*Attorney, Agent, or Firm*—Flynn, Thiel, Boutell & Tanis

[57] ABSTRACT

A heat-transmitting device for transmitting heat between first and second fluids respectively flowing through first and second containers has a heat transmitter which is secured to at least one of the containers. The heat transmitter includes at least one heat pipe which extends into each container, such that one end of the heat pipe is disposed in the first fluid and the other end is disposed in the second fluid. The containers are separated by a double wall construction, and the heat pipe extends through such double wall. Heat from the first liquid is transferred to and through the heat pipe and into the second liquid.

7 Claims, 7 Drawing Figures

SAFETY HEAT-TRANSMITTING DEVICE

This application is a division of U.S. Ser. No. 221,164, filed Dec. 29, 1980, now abandoned.

FIELD OF THE INVENTION

This invention relates to a heat-transmitting device for transmitting heat between a refrigerant and a fluid which is separate therefrom, in particular for heating up drinking and use water, in which a heat transmitter is secured on a fluid container and extends into the fluid container.

BACKGROUND OF THE INVENTION

During waste-heat recovery from cooling systems or cooling cycles (for example, according to German OS No. 2 530 994), the refrigerant is guided through a heat transmitter (for example, a condenser) which is built into the fluid container. The refrigerant emits its heat energy to the fluid (typically water) in the container, for example, through condensation in a pipe.

This known heat-transmitting device, however, requires large heat-transmitting surfaces and thus great pipe lengths. This effects a very high and undesirable pressure drop on the part of the refrigerant.

Aside from these disadvantages, one other need is not met by this system, namely, the demand which has come forth lately for increased safety in the preparation of drinking water. Specifically, the direct heating of drinking or use water is supposed to be avoided, since the refrigerant and the drinking water are separated only by one wall and thus the possible danger of a rupture and entrance of the refrigerant into the drinking water is significant.

Therefore, the basic purpose of the invention is to come up with a heat-transmitting device which fully meets the safety aspect for total separation of fluid and refrigerant, yet also provides optimum heat transmission.

SUMMARY OF THE INVENTION

The foregoing purpose is attained inventively by the heat transmitter being constructed with at least one heat pipe, one end of which heat pipe lies outside of the fluid container and is arranged in a refrigerant container which refrigerant flows through and which is separated from the fluid container by a double wall through which the heat pipe extends.

Thus, the invention provides a safety heat transmitter which secures the separation of the refrigerant from the fluid (typically drinking or use water), prevents a transfer of refrigerant into the fluid, and at the same time will indirectly indicate a possible leakage by a reduction in operating efficiency.

By using heat pipes as heat transmitters, the heat is transferred very quickly and with high efficiency from the side which supplies the heat to the side which discharges the heat. The heat pipes are thereby arranged in an arrangement which is common for example in transmitters having a cluster of pipes.

An extremely well-conducting heat transfer between refrigerant and fluid (drinking water) is effected through the closed heat pipe cycle, (see U.S. Pat. No. 4,067,345). To now also achieve a secure separation of the refrigerant-sided and water-sided chambers, the invention provides a double wall. Through this it is achieved that, in the case of a leakage from the refrigerant side or from the fluid side, the one medium does not contaminate the other but escapes instead to the surrounding area.

The breakdown of individual pipes, for example due to corrosion on the fluid side (water), is evidenced by a reduction in efficiency, for example during the heating of drinking water.

The inventive arrangement contains a further important advantage compared with common heat transmitters. In the case of a breakdown of one or several heat pipes, the heat transmitter remains operational even though with a reduced efficiency so that downtime, for example of the cooling system, is limited purely to rebuilding time.

In view of the above-mentioned safety aspect, a special embodiment of the invention consists of the heat pipes being filled with a substance which is neutral or nondangerous with respect to the fluid (typically drinking or use water) and its ultimate use.

In order to assure that no reverse heat transmission occurs, the heat pipes are preferably inclined, because the heat pipes usually do not operate against the force of gravity. The heat pipes may have an inner capillary structure, but this structure must be constructed so that reverse transmission does not occur.

When the heat-transmitting device is used as a condenser, the heat pipes are inclined downwardly toward the refrigerant side. In this case, when the fluid container is filled with water, the heat pipes are also preferably filled with water.

When the heat-transmitting device is used as an evaporator, for example where heat is supposed to be withdrawn from the fluid container, the heat pipes are inclined downwardly toward the fluid side. The fill medium in the heat pipes is therefore preferably a nondangerous alcohol such as ethanol, namely, an alcohol which is not health damaging for the water consumer.

According to a special embodiment of the invention, the space between the walls of the double wall is at least partially open to the surrounding area so that in the case of a leak, the leaking refrigerant or fluid can escape to the surrounding area.

A direct leakage indication is preferably realized by the space between the two walls being connected to an indicating device so that visual inspection is not the only way leakage can be detected.

Preferably, the heat-transmitting device has at least one part of the double wall constructed as a flanged member. This has particular advantages because a unit which consists of a refrigerant container, heat pipe and double wall can be selectively mounted on the fluid container in positions for use as an evaporator or a condenser. The same unit can thus be utilized as an evaporator or as a condenser, depending on which side the heat pipes are downwardly inclined toward. Such versatility is, for example, advantageous for seasonally switching over the operation of climate-control systems (for use as a cooling system or as a heat pump).

The fluid container is preferably constructed as a boiler or a forced-convection heat exchanger.

A further preferred embodiment of the invention consists of the heat-transmitting device having at least one core pipe and a jacket pipe which is placed around the core pipe, the heat pipe being formed by a core pipe which is closed off at its ends, and the refrigerant and fluid containers and the double wall being formed by parts of the jacket pipe which are separated at the center of the core pipe and which are each connected to the heat pipe, wherein next to the center of the core pipe openings in the two jacket pipe parts are provided. The evaporator and condenser exist preferably in a coaxial form.

The heat-transmitting device is advantageously designed either extended or curved. When curved, it is preferably spirally or helically wound.

When a wound heat-transmitting device is used as a condenser, the refrigerant flows in the lower part of the jacket pipe, whereas when it is used as an evaporator, the fluid flows in such lower part.

For the preferred use of the safety heat-transmitter as an oil cooler, the oil to be cooled flows through the lower part of the jacket pipe and water serving as a refrigerant flows through the upper part. Thus, through the safety heat-transmitter, it is particularly avoided that water enters the oil of a machine, which event could possibly have disadvantageous consequences for the machine.

The jacket pipe parts are each connected to the core pipe in an advantageous manner adjacent the center of the core pipe by insert pieces.

In a further improvement of the heat-transmitter, the ends of the heat pipe have outside ribs.

BRIEF DESCRIPTION OF THE DRAWINGS

The invention is described in greater detail in connection with the exemplary embodiments in the drawings, in which.

DETAILED DESCRIPTION

Figure 1:
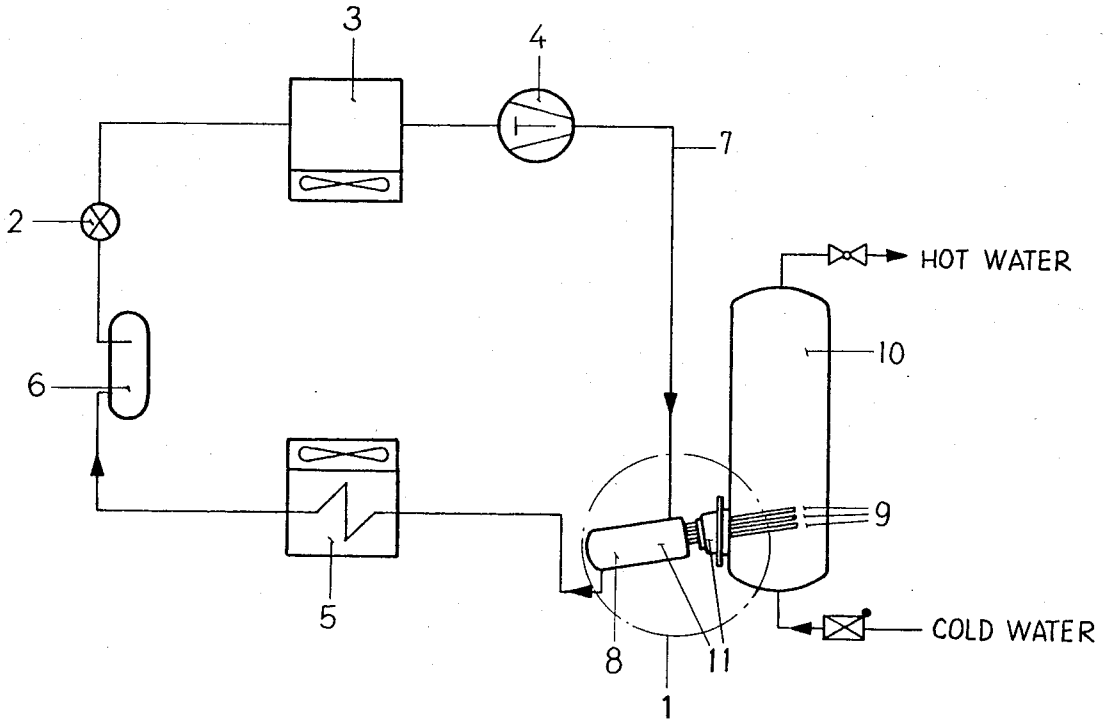
FIG. 1 illustrates an inventive safety heat-transmitting device in a condenser system for heating up use water.

In the system for heating up use water according to FIG. 1, a safety heat-transmitting device 1 is inserted into a common refrigeration system having an expansion valve 2, an evaporator 3, a compressor 4, an air-cooled condenser 5 and a collector 6, and having a refrigerant 7 which flows through the foregoing components. The system and these components operate in a conventional manner and such operation is therefore not described here in detail.

Figure 2:
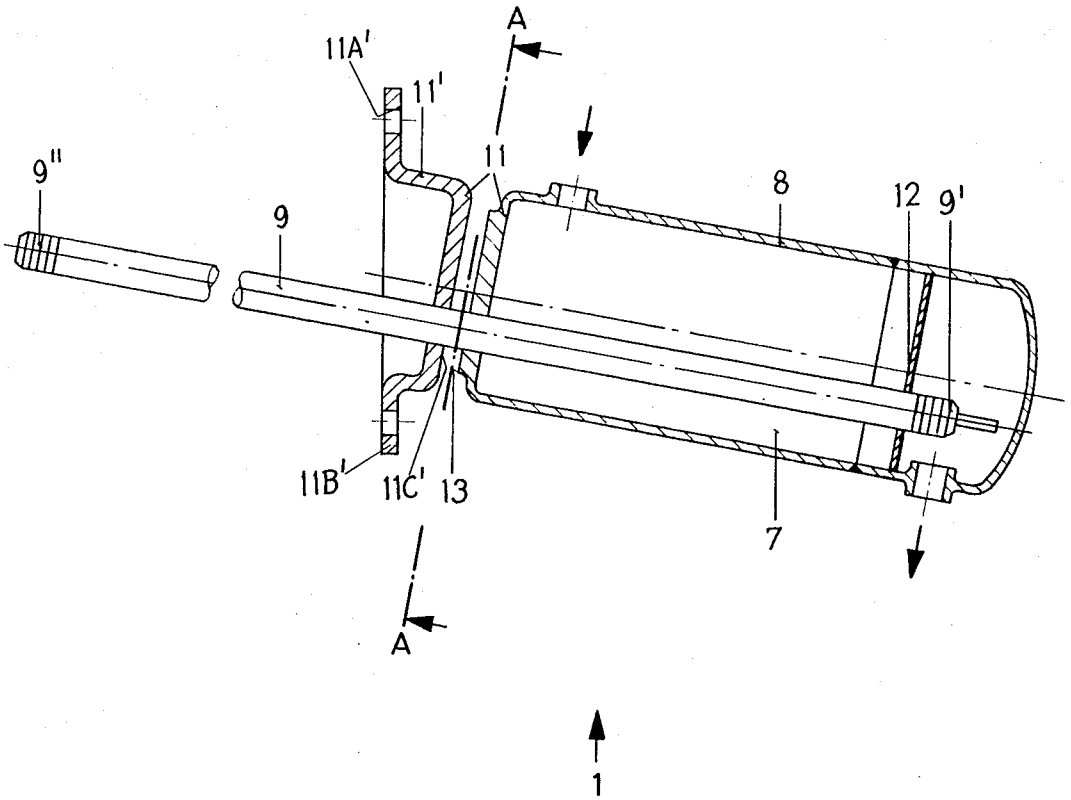
FIG. 2 is a longitudinal cross-sectional view of the heat-transmitting device of FIG. 1.

The heat-transmitting device 1 includes a refrigerant container 8, into which are inserted several heat pipes 9 (FIG. 2) which are preferably filled with water. (FIG. 2 illustrates for convenience only one of the several heat pipes 9). The heat pipes 9 extend through a double wall 11. The unit which is formed in this manner is secured by a flanged member 11' on a fluid container 10, which container is filled with water. Depending on the size of the refrigerant container 8, further not-illustrated supports may be required.

The flanged member 11' is preferably attached to the container 10 by not-illustrated bolts which extend through openings 11A' in the periphery of the flange 11B' and are threadedly engaged with the container 10. The flanged member 11' has a surface 11C' which is inclined with respect to the plane of the flange 11B' and the heat pipes 9 extend through the surface 11C' perpendicular thereto. Thus, the inclination of the heat pipes 9 can be controlled by the orientation given the flanged member 11' before it is bolted to the container 10.

Figure 3:
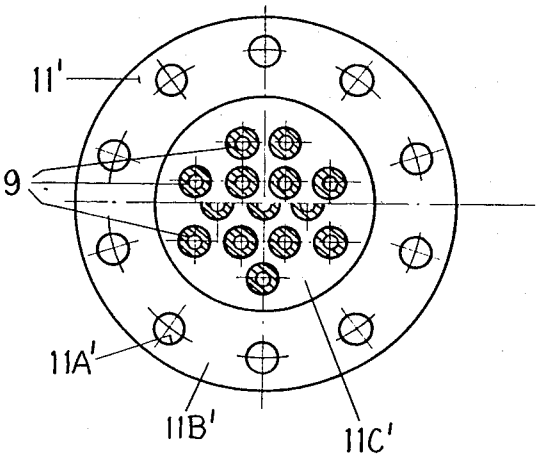
FIG. 3 is a cross-sectional view of a flanged member taken along the line A—A of FIG. 2.

From the cross section according to FIG. 3, one recognizes in the upper half as a possible design an aligned arrangement of the heat pipes 9, and in the lower half an alternative offset arrangement. Only one such arrangement would actually be present in any given device 1 and the arrangement of the pipes 9 in the upper and lower halves of such device 1 would be mirror images of each other.

We deal in the case of the heat pipes 9 with evacuated pipes which are closed off vacuum-tight at both ends 9' or 9'', which are ribbed on the outside at the ends 9' or 9'', and which are inclined downwardly toward the refrigerant side so that condensate therein can flow back down to the lower end. The heat pipes 9 are supported in the refrigerant container 8 by means of a circular multi-apertured wall 12 and one wall of the double wall 11. Each heat pipe 9 is preferably filled with water or with an alcohol, such as ethanol, which presents little danger to humans when consumed in limited quantities.

As the heat-transmitting device 1 operates, the refrigerant 7 flows through the refrigerant container 8 according to the arrows and transfers its heat energy to and through the heat pipes 9, and the pipes 9 in turn heat up the cold water flowing through the water container 10. In addition, a casing may be provided, if desired, which assures that, after the water is heated to the desired temperature, the condensation of the refrigerant takes place entirely in the air-cooled condenser 5.

Should leakage occur in one or several heat pipes 9, it will be detected through a drop in the efficiency of the heating of use water. In the case of a leakage in the double wall 11, either refrigerant 7 or water will exit to the outside and it is therefore advantageous to provide in the space 13 between the walls of the double wall 11 a conventional and not-illustrated detector for such leakage.

Figure 4:
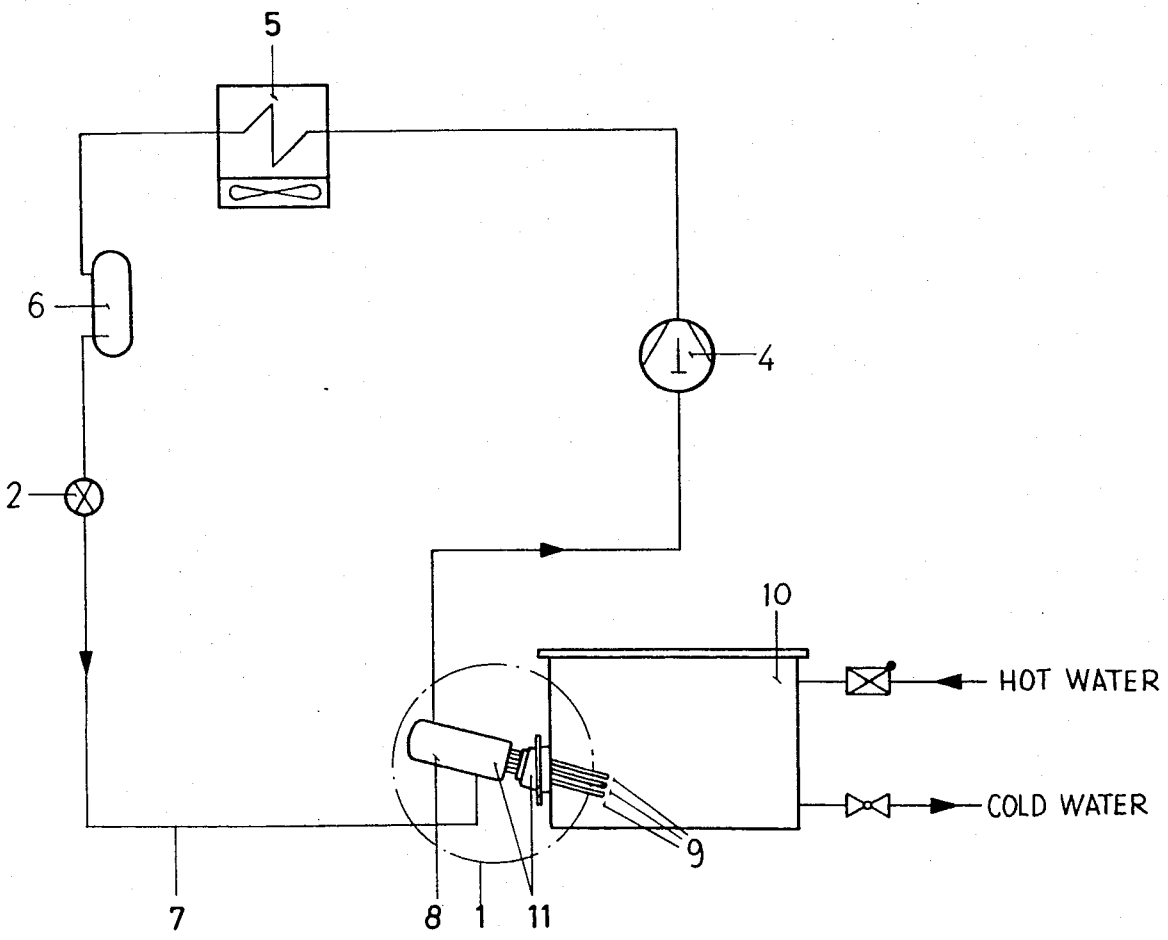
FIG. 4 illustrates the heat-transmitting device of FIG. 1 in an evaporator system.

FIG. 4 illustrates the above-described heat-transmitting device 1 in an evaporator system.

In contrast to FIG. 1, the heat-transmitting device 1 is inserted here upstream of the compressor 4 (relative to the direction of flow of the refrigerant 7) with the heat pipes 9 inclined downwardly toward the fluid side, and thus functions as an evaporator. The heat-transmitting device 1 of FIG. 4 differs from that of FIG. 1 mainly in that the flanged member 11 has been rotated 180° before being attached to the container 10 so that the heat pipes 9 extend downwardly, rather than upwardly, into the container 10. In this manner, the heat-transmitting device can be selectively positioned for use as a condenser (FIG. 1) or an evaporator (FIG. 4).

The fluid container 10 can be constructed as a boiler, as a "reservoir container" for waste water from which heat is withdrawn to achieve waste heat recovery, or as a forced-convection heat exchanger, through which for example ground water is pumped as an energy source for a heat pump. In these two cases, the air-cooled condenser 5 should generally be replaced with a water-cooled condenser.

The system according to FIG. 4 with the heat-transmitting device 1 can also be used for a water chiller for cooling of circulating water.

Good results were achieved for the intended purposes of use when the refrigerant container 8 of the pipe-assembly safety-heat transmitting device 1 had a length of 350 mm, and a diameter of 90 mm and a wall thickness of 3 mm, whereby 12 or 13 heat pipes 9 with interpipe spacing of 18 mm were arranged according to the pattern illustrated in the upper half of FIG. 3. The heat pipes 9 were of SF-Cu, were provided with inner longitudinal ribs and had the following dimensions:

| | |
|---|---|
| Length: | 750 mm |
| Outside diameter: | 16 mm |
| Core diameter: | 9 mm |
| Number of inner ribs: | 25 |
| Rib height of the outer ribs: | 1.55 mm |

The filled capacity of each pipe 9 amounted to 6 grams of water. At the above length of 750 mm of the heat pipes 9 and with a width of the space 13 of 20 mm, the heat pipes 9 extended into the fluid container 10 approximately 400 mm.

Figure 5:
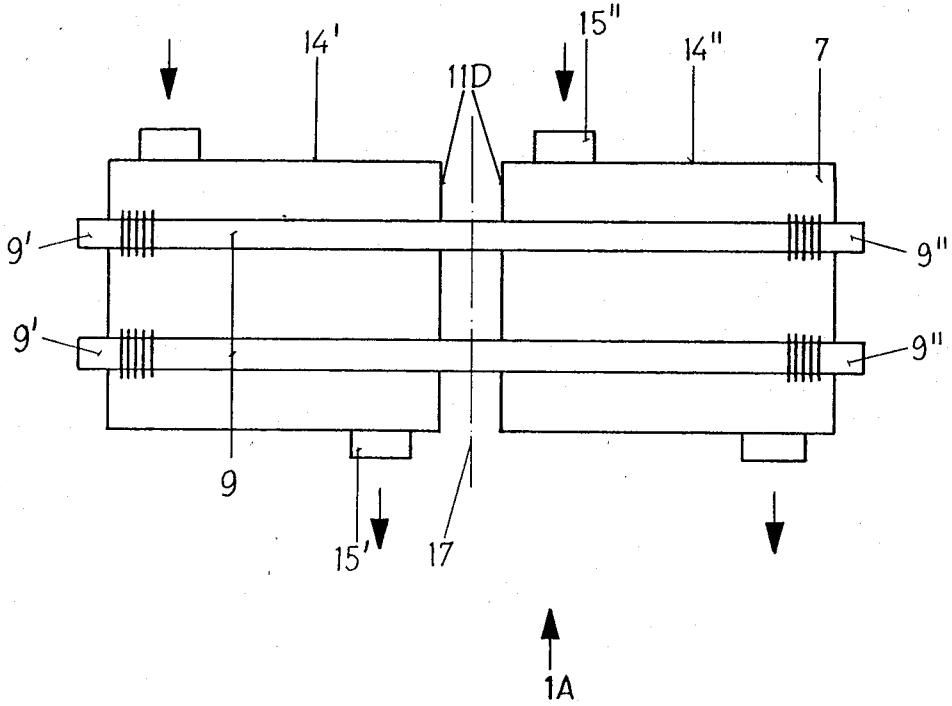
FIG. 5 illustrates a heat-transmitting device having an extended design.

In the heat-transmitting device 1A having the extended or stretched-out design illustrated in FIG. 5, heat pipes 9 are arranged in the parts 14' and 14'' of a jacket pipe 14, the fluid container being thereby formed by the part 14' and the refrigerant container by the part 14''. The double wall 11A which is arranged at the center 17 of the device 1 is created by walls connecting the respective parts 14' or 14'' to the heat pipes 9. Openings 15'' and 15' respectively for the refrigerant 7 and the fluid are provided next to the double wall 11D.

Figure 6:
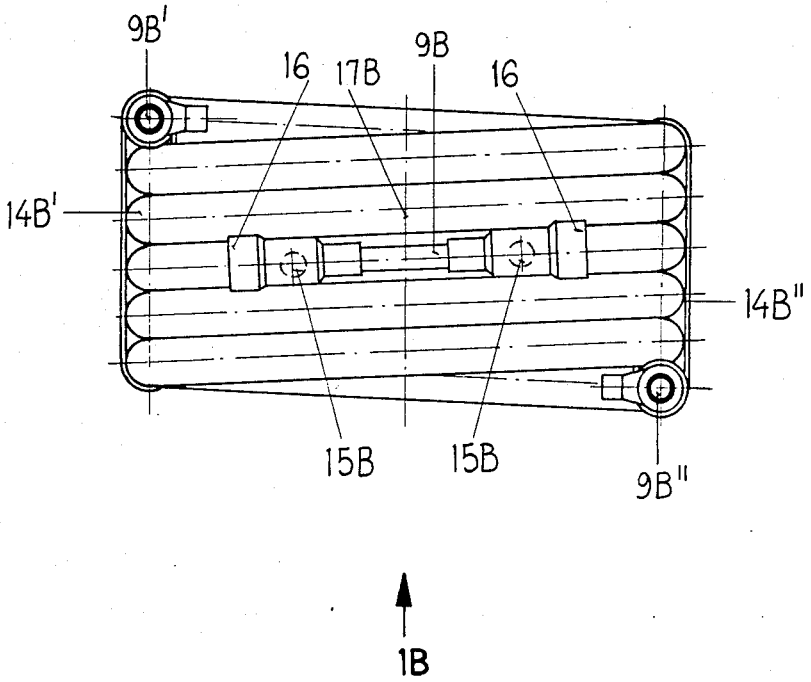
FIG. 6 is a side view of a coaxial heat-transmitting device of helical design.
Figure 7:
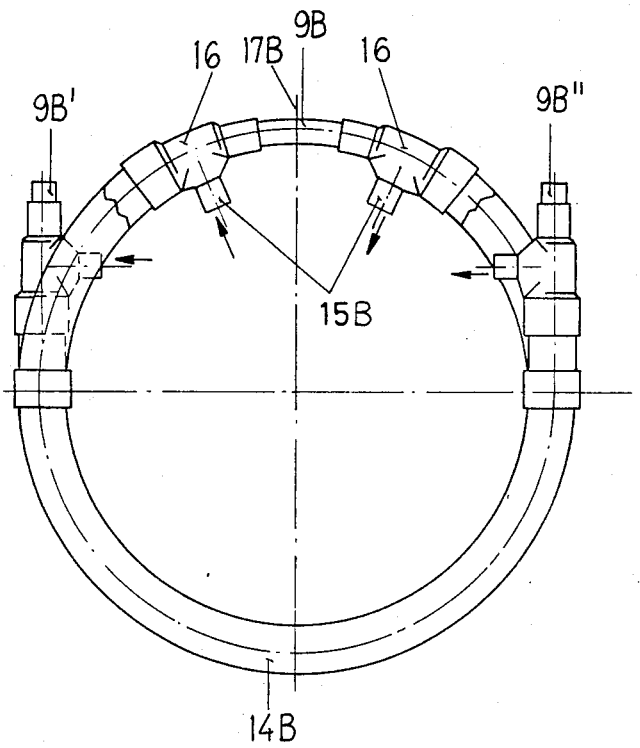
FIG. 7 is a fragmented bottom view of the device of FIG. 6.

FIGS. 6 and 7 illustrate an alternative heat-transmitting device 1B having a helical shape. Only one heat pipe 9B is provided here, and it is coaxially arranged within and spaced from the parts 14B' and 14B'' of the jacket pipe 14B. The parts 14B' and 14B'' are sealingly connected to the heat pipe 9B adjacent the axial center of the pipe 9B by insert pieces 16. The insert pieces 16 have openings 15B for the refrigerant and fluid, which flow according to the arrows in FIG. 7. The use as a condenser is shown, namely, the refrigerant container is formed by the radial space between the pipe 9B and the lower part 14B'' and the fluid container is formed by the radial space between the pipe 9B and the upper part 14B'. When using the heat-transmitting device 1B of FIGS. 6 and 7 as an oil cooler, oil is in the lower part 14B'' and water is in the upper part 14B'. As in the embodiment of FIGS. 1–3, the refrigerant and fluid are at all times separated by at least two walls.

Good results were achieved with a helically wound coaxial heat-transmitting device 1B having 4 or 5 windings and a winding diameter of 260 mm. The jacket pipe 14B was of SF-Cu, had a length of 3700 mm, a diameter of 25 mm and a wall thickness of 1 mm. The heat pipe 9B was constructed in a manner analogous to the heat pipes in the embodiment of FIGS. 1–3 and had a length of approximately 3900 mm. The filled capacity of the pipe 9B amounted to 35 grams of water.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A heat transmitting device adapted to transmit heat between two different fluid mediums, comprising an elongate heat pipe and first and second pipelike jacket parts, said elongate heat pipe extending completely through said pipelike jacket parts substantially parallel thereto and said pipelike jacket parts being spaced from each other along the length of said heat pipe, wherein each of said pipelike jacket parts is sealingly connected at each end thereof to said heat pipe and includes means defining an inlet opening and an outlet opening, each of said pipelike jacket parts being adapted to have a respective said fluid medium flowing therethrough from said inlet opening to said outlet opening thereof, wherein said heat pipe is curved, and wherein said heat pipe is one of a spiral and a helix.

2. The heat transmitting device according to claim 1, wherein said heat pipe and said jacket parts are generally cylindrical, and wherein said heat pipe is coaxially disposed within said jacket parts.

3. The heat transmitting device according to claim 1, wherein said fluid medium flowing through one of said jacket parts is a refrigerant.

4. The heat transmitting device according to claim 1, wherein said fluid medium flowing through one of said jacket parts is oil and said fluid medium flowing through the other said jacket part is water.

5. The heat transmitting device according to claim 1, wherein the adjacent ends of said jacket parts are each connected by a respective insertion piece to said heat pipe.

6. The heat transmitting device according to claim 1, wherein said heat pipe has ribbing on at least a portion of the exterior thereof.

7. A heat transmitting device which is adapted to transmit heat between first and second fluid mediums, comprising first and second jacket pipes and an elongate heat pipe which extends coaxially through each said jacket pipe, said jacket pipes being axially spaced from each other along the length of said heat pipe and each said jacket pipe being sealingly connected at each axial end thereof to said heat pipe, wherein each said jacket pipe has means defining an inlet opening and an outlet opening adjacent opposite axial ends thereof and is adapted to have a respective one of said fluid mediums flowing therethrough from said inlet opening to said outlet opening thereof, and wherein said heat pipe and said jacket pipes thereon are coiled generally helically.

* * * * *